US010480167B2

(12) United States Patent
Tanimoto et al.

(10) Patent No.: US 10,480,167 B2
(45) Date of Patent: Nov. 19, 2019

(54) FLUSH WATER SUPPLY APPARATUS

(71) Applicant: TOTO LTD., Kitakyushu-shi, Fukuoka (JP)

(72) Inventors: Hideki Tanimoto, Kitakyushu (JP); Kenji Hatama, Kitakyushu (JP)

(73) Assignee: TOTO LTD., Kitakyushu-shi, Fukuoka (JP)

( * ) Notice: Subject to any disclaimer, the term of this patent is extended or adjusted under 35 U.S.C. 154(b) by 0 days.

(21) Appl. No.: 15/987,754

(22) Filed: May 23, 2018

(65) Prior Publication Data

US 2018/0340322 A1 Nov. 29, 2018

(30) Foreign Application Priority Data

May 25, 2017 (JP) ..... 2017-103720

(51) Int. Cl.
*E03D 1/32* (2006.01)

(52) U.S. Cl.
CPC ..... *E03D 1/32* (2013.01)

(58) Field of Classification Search
CPC ..... E03D 1/32; E03D 1/304; E03D 1/33
USPC ..... 4/353
See application file for complete search history.

(56) References Cited

U.S. PATENT DOCUMENTS 6,666,228 B1 * 12/2003 Li ..... F16K 21/18 137/426
6,755,209 B2 * 6/2004 Wey ..... E03D 1/32 137/218
2012/0318382 A1 * 12/2012 Magar ..... E03D 1/00 137/409
2014/0048157 A1 * 2/2014 Fu ..... E03D 1/32 137/409

* cited by examiner

*Primary Examiner* — Huyen D Le
(74) *Attorney, Agent, or Firm* — BakerHostetler

(57) ABSTRACT

A float-position adjusting member is circumferentially rotatable around an axis thereof so that a relative position between an arm and a float is adjustable. A small-tank-position adjusting member is also circumferentially rotatable around an axis thereof so that a vertical position to which a small tank is supported is adjustable. These adjusting members are coaxially arranged. When the float-position adjusting member is rotated in one direction, a first contact part of the float-position adjusting member comes in contact with a first contact part of the small-tank-position adjusting member for their corotation. When the small-tank-position adjusting member is rotated in the other direction, second contact parts of the adjusting members come in contact with each other for their corotation. There is no corotation between the contact state of the first contact parts and the contact state of the second contact parts, whose rotational angle is 10 degrees or more.

9 Claims, 14 Drawing Sheets

FLUSH WATER SUPPLY APPARATUS

TECHNICAL FIELD

The present invention pertains to a flush water supply apparatus, and more particularly to a flush water supply apparatus for supplying flush water into a flush water tank of a toilet.

BACKGROUND ART

Conventionally, for example as described in U.S. Pat. No. 6,755,209, a flush water supply apparatus for supplying flush water into a flush water tank of a toilet has been known wherein the flush water supply apparatus adopts a structure including: a small tank which has a shape like a bucket and whose bottom surface has an opening; a float provided in the small tank; and a water supply valve movable in a horizontal direction in conjunction with a vertical movement of the float. In general, the water supply valve is a diaphragm valve.

In addition, as described in JP-A-2011-64008 and JP-A-2013-204389, another structure of the flush water supply apparatus has been known wherein the position of a small tank and the position of a float are adjustable.

FIG. 16 of the present patent application corresponds to FIG. 4 of JP-A-2013-204389 (although the numeral signs are changed). The flush water supply apparatus shown in FIG. 16 includes: a water supply valve 136 for switching between a supply (dispensing) state and a stop state of flush water supplied from a water supply pipe 134 provided with a filter 150, into a flush water tank; a small tank 138 movable in a vertical direction along the water supply pipe 134; and a float 142 provided in the small tank 138. The float 142 is slidable against the small tank 138 in a vertical direction in conjunction with a change of a flush water level in the small tank 138.

Then, a swinging member 144 (e.g. swinging arm) is provided pivotably around a fulcrum on a valve housing supported by the water supply pipe 134. When the swinging member 144 is pivoted, a pilot hole 136*g* is opened or closed, which causes the water supply valve 136 to switch between the supply (dispensing) state and the stop state.

The pivoting (swinging) movement of the swinging member 144 is caused by a vertical movement of the float 142. That is to say, the swinging member 144 is connected to the float 142. Herein, the swinging member 144 and the float 142 are connected via a float-position adjusting member 148 so that the relative position between the swinging member 144 and the float 142 is adjustable.

Specifically, the float-position adjusting member 148 is in general a substantially tubular member. A male threaded part is provided on an outer side surface of the float-position adjusting member 148. On the other hand, a female threaded part is provided on a portion of an inner side surface of an attachment hole formed at a center part of the float 142. Then, the male threaded part and the female threaded part are engaged to each other threadedly. Thus, when the float-position adjusting member 148 is circumferentially rotated around an axis thereof, the relative position between the float-position adjusting member 148 and the float 142 is adjusted so that the relative position between the swinging member 144 and the float 142 is adjustable.

Furthermore, a rotatable shaft member 146 extends axially through the float-position adjusting member 148. The rotatable shaft member 146 is supported by the water supply pipe 134 (in such a manner that a rotation of the rotatable shaft member 146 is allowed) so that the rotatable shaft member 146 is vertically suspended. A male threaded part is provided on an outer side surface of a lower portion of the rotatable shaft member 146. On the other hand, a female threaded part is provided on a portion of an inner side surface of an attachment hole formed at a center part of the small tank 138. Then, the male threaded part and the female threaded part are engaged to each other threadedly. Thus, when the rotatable shaft member 146 is circumferentially rotated around an axis thereof, the relative position between the rotatable shaft member 146 and the small tank 138 is adjusted (the small tank 138 is vertically moved along the water supply pipe 134).

Herein, it is not easy to directly operate the rotatable shaft member 146 because the diameter of the rotatable shaft member 146 is relatively small. Therefore, a corotation structure as shown in FIG. 17 has been adopted wherein the rotatable shaft member 146 is rotated together with the float-position adjusting member 148 when the float-position adjusting member 148 is circumferentially rotated.

PATENT DOCUMENT LIST

U.S. Pat. No. 6,755,209
JP-A-2011-64008
JP-A-2013-204389

SUMMARY OF INVENTION

Technical Problem

The flush water supplied from the water supply pipe 134 passes through the filter 150. Thus, it is prevented that any large-sized dust in the flush water is supplied into the flush water tank. However, some small-sized dust may pass through the filter 140. When such a small-sized dust arrives at and fills the gap of the corotation structure as shown in FIG. 17, the float-position adjusting member 148 may become vertically immovable, which may make it impossible for the flush water supply apparatus to normally operate.

The present invention has been made based on the above findings by the inventors. The object of the present invention is to provide a flush water supply apparatus which can remarkably reduce possibility of operational problem caused by a small-sized dust that may pass through a filter.

Solution to Problem

The present invention is a flush water supply apparatus for supplying flush water into a flush water tank of a toilet, the flush water supply apparatus including: a water supply valve for switching between a supply state and a stop state of flush water supplied from a water supply pipe into a flush water tank; a small tank provided in the flush water tank; a float provided in the small tank, the float being slidable against the small tank in a vertical direction in conjunction with a change of a flush water level in the small tank; an arm for causing the water supply valve to switch between the supply state and the stop state, in conjunction with a vertical movement of the float against the small tank; a float-position adjusting member connected to the arm and the float, the float-position adjusting member being circumferentially rotatable around an axis thereof so that a relative position between the arm and the float is adjustable; and a small-tank-position adjusting member connected to the small tank, the small-tank-position adjusting member being circumferentially rotatable around an axis thereof so that a vertical position to which the small tank is supported is adjustable; wherein the float-position adjusting member and the small-tank-position adjusting member are coaxially arranged; when the float-position adjusting member is rotated in one direction, a first contact part of the float-position adjusting member comes in contact with a first contact part of the small-tank-position adjusting member so that the float-position adjusting member and the small-tank-position adjusting member are rotated in the one direction together with each other, and/or when the small-tank-position adjusting member is rotated in the other direction, the first contact part of the small-tank-position adjusting member comes in contact with the first contact part of the float-position adjusting member so that the float-position adjusting member and the small-tank-position adjusting member are rotated in the other direction together with each other; when the float-position adjusting member is rotated in the other direction, a second contact part of the float-position adjusting member comes in contact with a second contact part of the small-tank-position adjusting member so that the float-position adjusting member and the small-tank-position adjusting member are rotated in the other direction together with each other, and/or when the small-tank-position adjusting member is rotated in the one direction, the second contact part of the small-tank-position adjusting member comes in contact with the second contact part of the float-position adjusting member so that the float-position adjusting member and the small-tank-position adjusting member are rotated in the one direction together with each other; the float-position adjusting member and the small-tank-position adjusting member are rotatable to each other from a state wherein the first contact part of the float-position adjusting member is in contact with the first contact part of the small-tank-position adjusting member to another state wherein the second contact part of the float-position adjusting member is in contact with the second contact part of the small-tank-position adjusting member; and an angle by which the float-position adjusting member and the small-tank-position adjusting member are rotatable relative to each other is 10 degrees or more.

According to the above feature, from a state wherein the first contact part of the float-position adjusting member is in contact with the first contact part of the small-tank-position adjusting member to another state wherein the second contact part of the float-position adjusting member is in contact with the second contact part of the small-tank-position adjusting member, the float-position adjusting member and the small-tank-position adjusting member are not rotated together with each other, but can rotate relative to each other by 10 degrees or more. That is to say, such a "play" is provided intentionally. Then, the "play" can function as a passage through which even a small-sized dust can pass. This can remarkably reduce the possibility that a small-sized dust fills the gap between the float-position adjusting member and the small-tank-position adjusting member so that the float-position adjusting member becomes vertically immovable to make it impossible for the flush water supply apparatus to normally operate.

However, if the angle by which the float-position adjusting member and the small-tank-position adjusting member are rotatable relative to each other is too large, the operation for adjusting the relative position is not easy. Thus, it is preferable that the angle by which the float-position adjusting member and the small-tank-position adjusting member are rotatable relative to each other is less than 120 degrees.

For example, the arm is supported by the flush water tank or the water supply pipe in a movable manner, the arm is configured to cause the water supply valve to switch between the supply state and the stop state in accordance with a movement of the arm, the float-position adjusting member is supported by the flush water tank or the water supply pipe via the arm, and the small tank is supported by the flush water tank or the water supply pipe via the small-tank-position adjusting member.

In addition, it is preferable that: a part of the water supply pipe extends into the flush water tank, the small tank is supported by the water supply pipe via the small-tank-position adjusting member and a bracket member, and the small-tank-position adjusting member is supported by the bracket member in such a manner that the small-tank-position adjusting member is circumferentially rotatable around an axis of the small-tank-position adjusting member against the bracket member.

In this case, it is relatively easy to execute a rotational operation of the small-tank-position adjusting member. Thus, both rotational operations for the float-position adjusting member and the small-tank-position adjusting member are facilitated.

In addition, it is preferable that: one set of the first and second contact parts of the float-position adjusting member and the first and second contact parts of the small-tank-position adjusting member are parts of one or more outward projections which project outwardly from an outside surface of a solid shaft member or a hollow tubular member, and the other set of the first and second contact parts of the float-position adjusting member and the first and second contact parts of the small-tank-position adjusting member are parts of one or more inward projections which project inwardly from an inside surface of another hollow tubular member.

In this case, the float-position adjusting member and the small-tank-position adjusting member can be formed by inside and outside (double) members, which cab stabilize the corotation movements.

In addition, in this case, it is further preferable that each of the one or more outward projections and/or the one or more inward projections is one of a plurality of projections formed at regular intervals circumferentially.

In this case, areas among the plurality of projections (relative concave portions) can serve as passages through which even a small-sized dust can pass. This can more remarkably reduce the possibility that a small-sized dust fills the gap between the float-position adjusting member and the small-tank-position adjusting member so that the float-position adjusting member becomes vertically immovable to make it impossible for the flush water supply apparatus to normally operate.

In addition, it is preferable that: when the first contact part of the float-position adjusting member comes in contact with the first contact part of the small-tank-position adjusting member, a third contact part of the float-position adjusting member comes in contact with a third contact part of the small-tank-position adjusting member, and when the second contact part of the float-position adjusting member comes in contact with the second contact part of the small-tank-position adjusting member, a fourth contact part of the float-position adjusting member comes in contact with a fourth contact part of the small-tank-position adjusting member.

In this case, the float-position adjusting member and the small-tank-position adjusting member are rotated while the two (or more) sets of contact parts are in contact, which can stabilize the corotation movements.

In addition, in this case, it is further preferable that: the first contact part and the third contact part of the float-position adjusting member are substantially symmetrically located with respect to an axis of the float-position adjusting member, the second contact part and the fourth contact part of the float-position adjusting member are substantially symmetrically located with respect to the axis of the float-position adjusting member, the first contact part and the third contact part of the small-tank-position adjusting member are substantially symmetrically located with respect to an axis of the small-tank-position adjusting member, and the second contact part and the fourth contact part of the small-tank-position adjusting member are substantially symmetrically located with respect to the axis of the small-tank-position adjusting member.

In this case, the float-position adjusting member and the small-tank-position adjusting member are rotated while the two (or more) sets of contact parts located at well-balanced positions are in contact. This can stabilize the corotation movements even if a so-called side-moving (deviation) happens between the float-position adjusting member and the small-tank-position adjusting member.

In addition, the small-tank-position adjusting member may be located below a water-stop level in the flush water tank.

As described above, the present invention can remarkably reduce the possibility that a small-sized dust fills the gap between the float-position adjusting member and the small-tank-position adjusting member so that the float-position adjusting member becomes vertically immovable to make it impossible for the flush water supply apparatus to normally operate. Thus, even if a small-sized dust floats in the water and sticks to the small-tank-position adjusting member, no problem is raised.

Advantageous Effects of Invention

According to the above feature, from a state wherein the first contact part of the float-position adjusting member is in contact with the first contact part of the small-tank-position adjusting member to another state wherein the second contact part of the float-position adjusting member is in contact with the second contact part of the small-tank-position adjusting member, the float-position adjusting member and the small-tank-position adjusting member are not rotated together with each other, but can rotate relative to each other by 10 degrees or more. That is to say, such a "play" is provided intentionally. Then, the "play" can function as a passage through which even a small-sized dust can pass. This can remarkably reduce the possibility that a small-sized dust fills the gap between the float-position adjusting member and the small-tank-position adjusting member so that the float-position adjusting member becomes vertically immovable to make it impossible for the flush water supply apparatus to normally operate.

DESCRIPTION OF EMBODIMENTS

Figure 1:
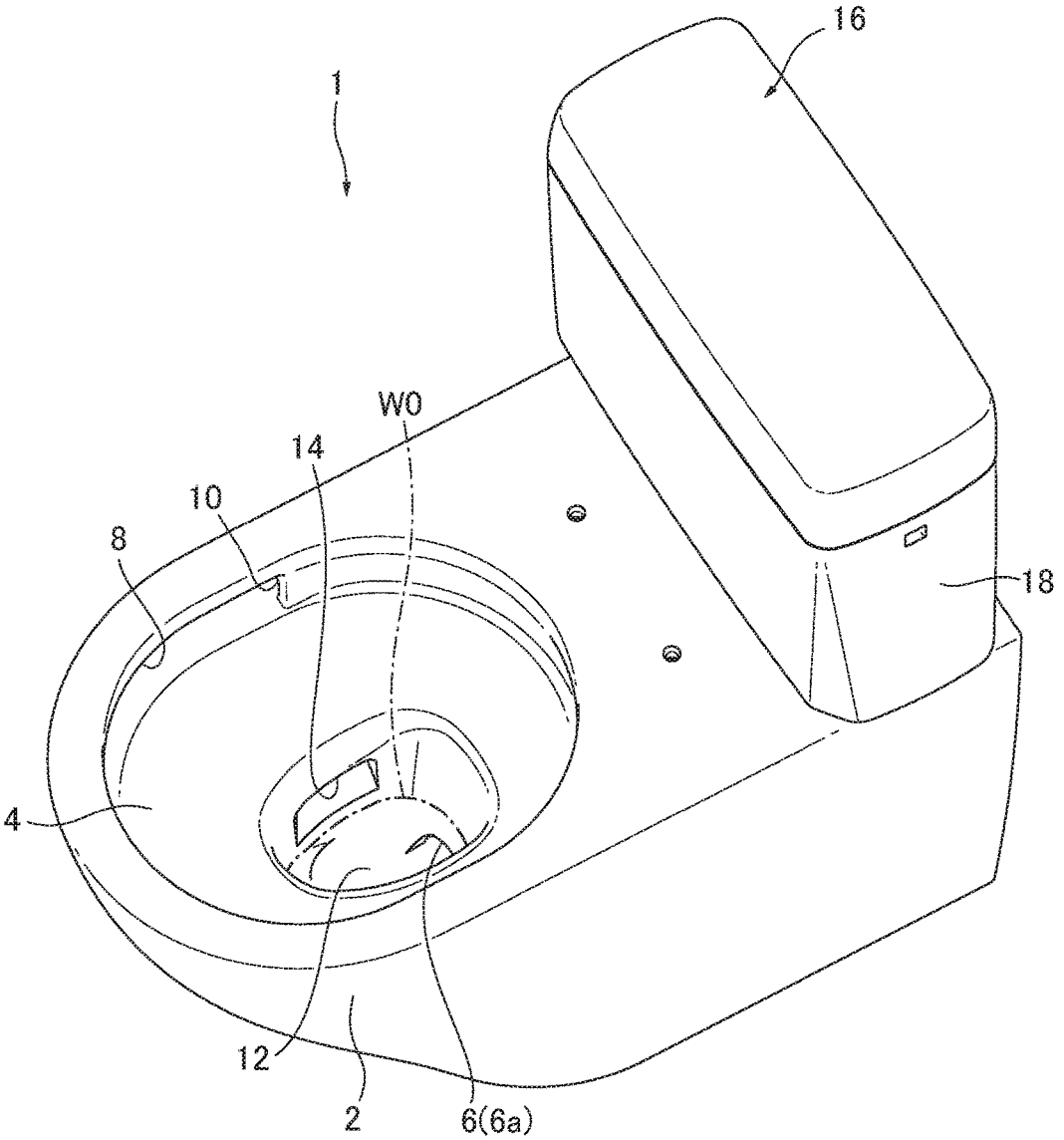
FIG. 1 is a perspective view of a flush toilet including a flush water tank apparatus having a flush water supply apparatus according to a first embodiment of the present invention, in which a toilet seat and a cover are removed.

With reference to the attached drawings, we explain a flush water supply apparatus according to a first embodiment of the present invention. FIG. 1 is a perspective view of a flush toilet including a flush water tank apparatus having a flush water supply apparatus according to the first embodiment, in which a toilet seat and a cover are removed.

(Basic Structure)

As shown in FIG. 1, the numeral sign 1 shows a siphon type of flush toilet which uses a siphon action to suck and discharge waste in a bowl portion through a discharge trap conduit at a time. The flush toilet 1 includes a toilet main unit 2 made of porcelain. The toilet main unit 2 has a bowl portion 4 and a discharge trap conduit 6 connected to a lower part of the bowl portion 4.

At an upper edge area of the bowl portion 4, an inner over-hanged rim 8 is formed, and a first spout port 10 is also formed to spout flush water supplied from a water passage (not shown) formed in a rear portion of the toilet main unit 2. The flush water spouted from the first spout port 10 descends while swiveling and flushes (washes) the bowl portion 4.

A water storage part 12 is formed at a lower part of the bowl portion 4. The water level of the water storage part 12 is shown by a dot-and-dash line WO. An entrance 6*a* of the discharge trap conduit 6 is opened below the water storage part 12. The discharge trap conduit 6 following the entrance 6*a* is connected to a discharging pipe (not shown) below the floor via a discharging socket (not shown).

Above the water level WO of the water storage part 12, a second spout port 14 is formed to spout flush water supplied from another water passage (not shown) formed in the rear portion of the toilet main unit 2. The flush water spouted from the second spout port 14 generates a swiveling flow, which causes the water stored in the water storage part 12 to swivel in a vertical direction.

Figure 2:
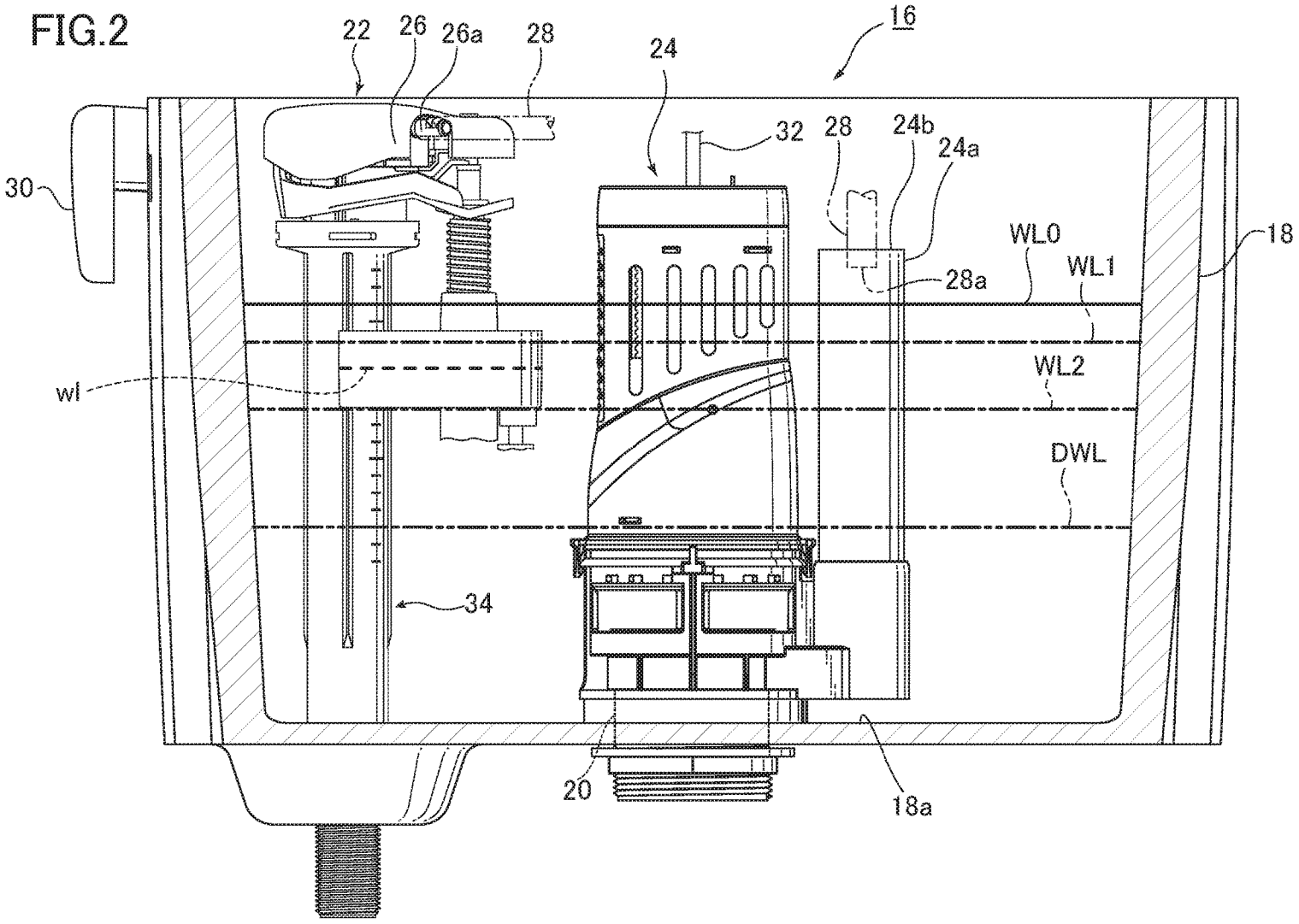
FIG. 2 is a front longitudinal section view of the flush water tank apparatus having the flush water supply apparatus according to the first embodiment.

In the first embodiment, a flush water tank apparatus 16 is provided on the rear portion of the toilet main unit 2. The flush water tank apparatus 16 stores the flush water for supplying to the toilet main unit 2. FIG. 2 is a front longitudinal section view of the flush water tank apparatus 16 having the flush water supply apparatus according to the first embodiment. In FIG. 2, the water level of fully stored water in a water storage tank is shown by a solid line WLO, a water stop level is shown by a dot-and-dash line WL1, and a dead water level is shown by a two-dot chain line DWL. In addition, the water level of the water storage tank when the flush water supply apparatus starts supplying the flush water is shown by a dot-and-dash line WL2, and the water level in a small tank when the flush water supply apparatus starts supplying the flush water is shown by a broken line w1.

As shown in FIGS. 1 and 2, the flush water tank apparatus 16 has the water storage tank 18 as a flush water tank that stores the flush water for flushing (washing) the flush toilet 1. A discharging port 20 communicating to the water passage (not shown) of the toilet main unit 2 is formed at a bottom of the water storage tank 18. Thereby, the flush water in the water storage tank 18 can be supplied to the water passage (not shown) of the toilet main unit 2. The volume of the stored water in the water storage tank 18 may vary depending on a kind of a flush toilet.

In addition, as shown in FIG. 2, in the water storage tank 18 of the flush water tank apparatus 16, the flush water supply apparatus 22 that supplies the flush water into the water storage tank 18 is provided, and a discharging valve apparatus 24 is also provided, which opens the discharging port 20 and causes the flush water stored in the water storage tank 18 to flow into the water passage (not shown) of the toilet main unit 2.

A vertically extending overflow pipe 24*a* is provided lateral to the discharging valve apparatus 24. A lower portion of the overflow pipe 24*a* communicates with the discharging port 20. When the water level in the water storage tank 18 rises beyond the full water level WLO and reaches an upper end opening 24*b* of the overflow pipe 24*a*, the flush water flows into the overflow pipe 24*a* through the upper end opening 24*b* and then flows into the water passage (not shown) of the toilet main unit 2 through the discharging port 20.

Furthermore, an upstream end of a hose 28 for make-up water is connected to a make-up water pipe 26*a* of a make-up water apparatus 26. A downstream end of the hose 28 is arranged just above the overflow pipe 24*a* or inside the overflow pipe 24*a*. Thereby, make-up water supplied from the make-up water pipe 26*a* into the hose 28 can flow into the overflow pipe 24*a*, and then can serve as refilling water (make-up water) for the toilet main unit 2.

The structure of the discharging valve apparatus 24 is the same as that of the conventional discharging valve apparatus. When an operational lever 30 attached on the outside of the water storage tank 18 is rotated in a predetermined direction to execute a predetermined flushing mode (for solid waste or for urine), an operational wire connected to the operational lever 30 is moved to lift up a valve body (not shown) in the discharging valve apparatus 24. Thus, the discharging port 20 is opened for a predetermined time period, so that a predetermined amount of the flush water in the storage tank 18 is discharged into the water passage (not shown) of the toilet main unit 2.

Figure 3:
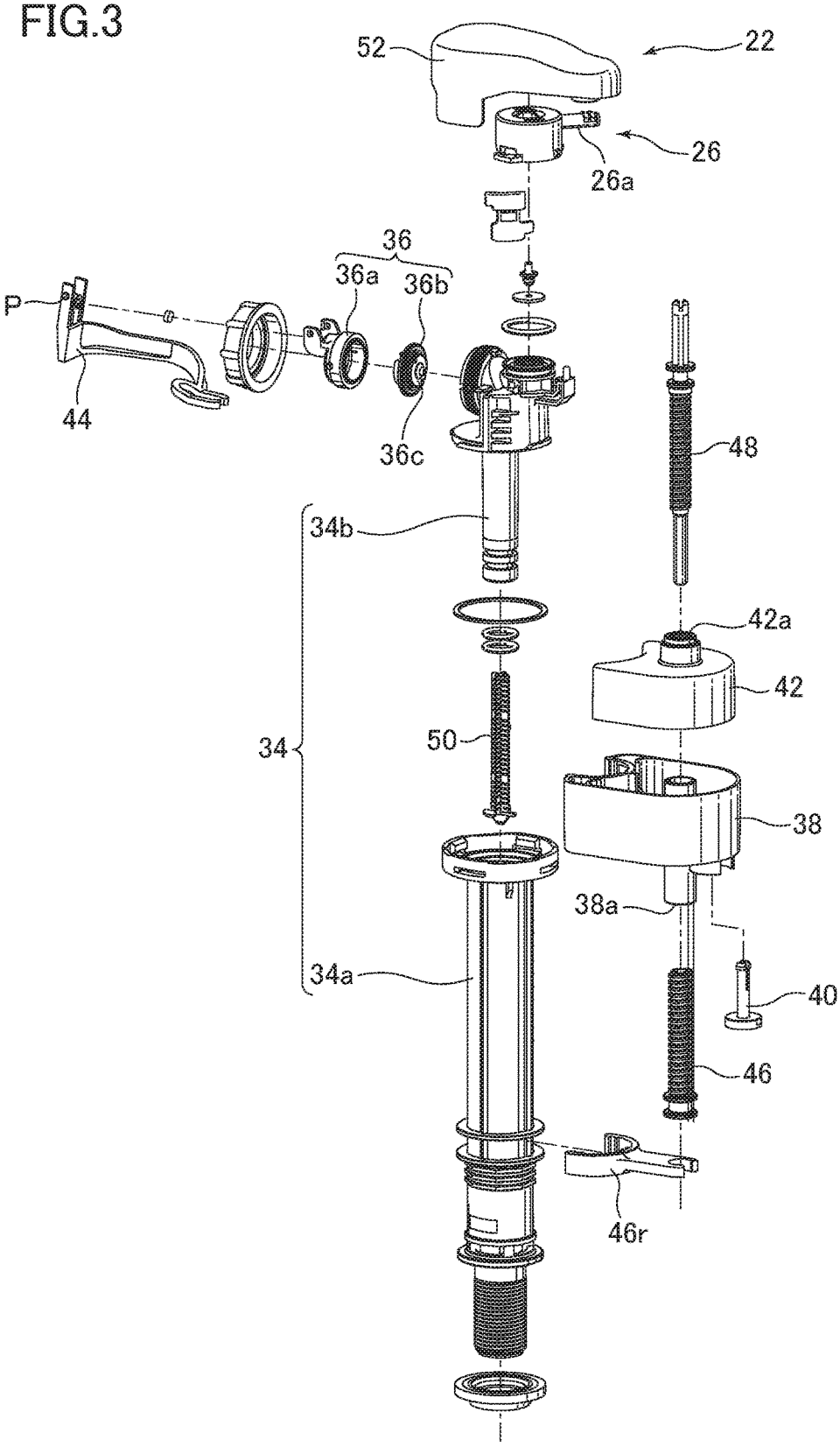
FIG. 3 is an exploded perspective view of the flush water supply apparatus according to the first embodiment.
Figure 4:
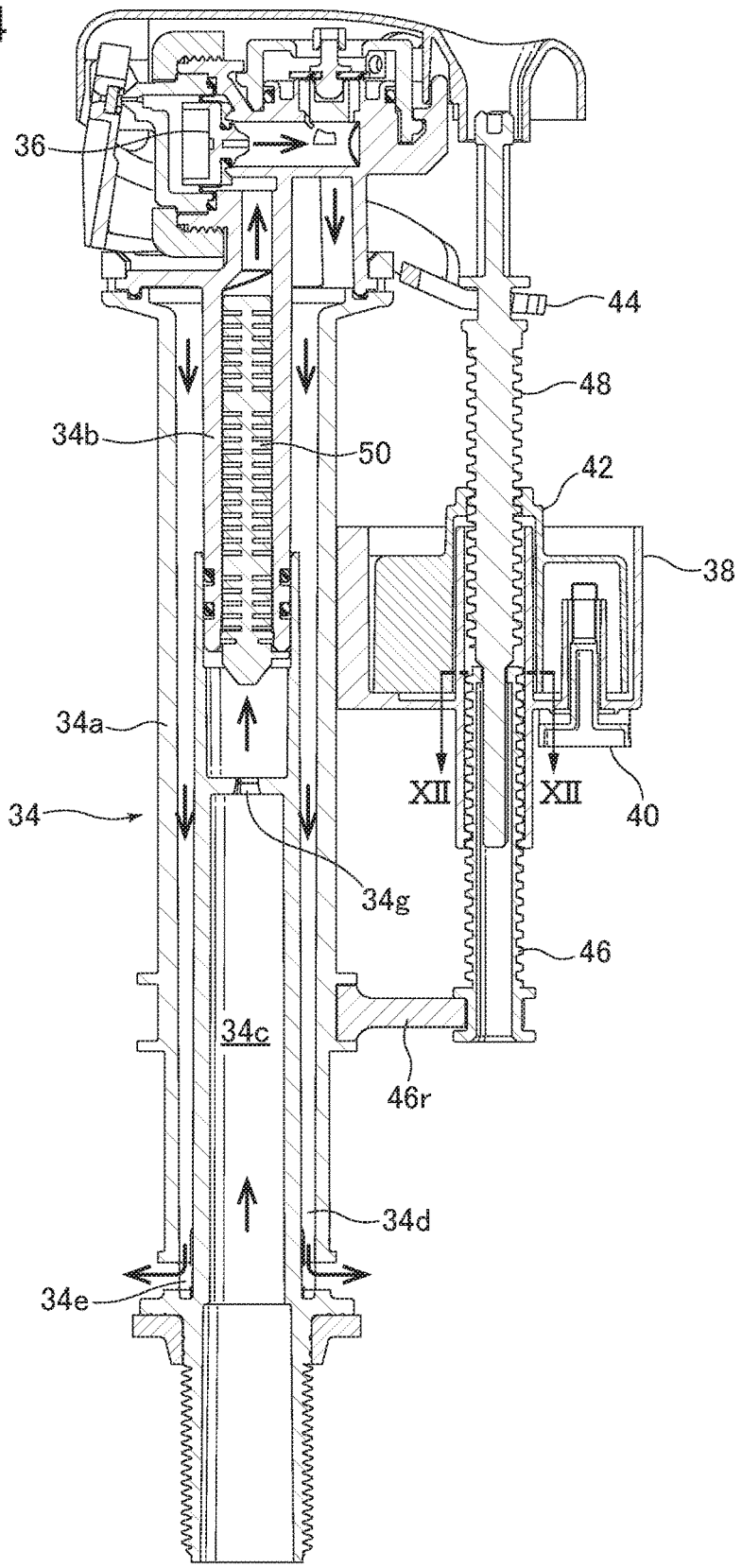
FIG. 4 is a front longitudinal section view of the flush water supply apparatus according to the first embodiment.
Figure 5:
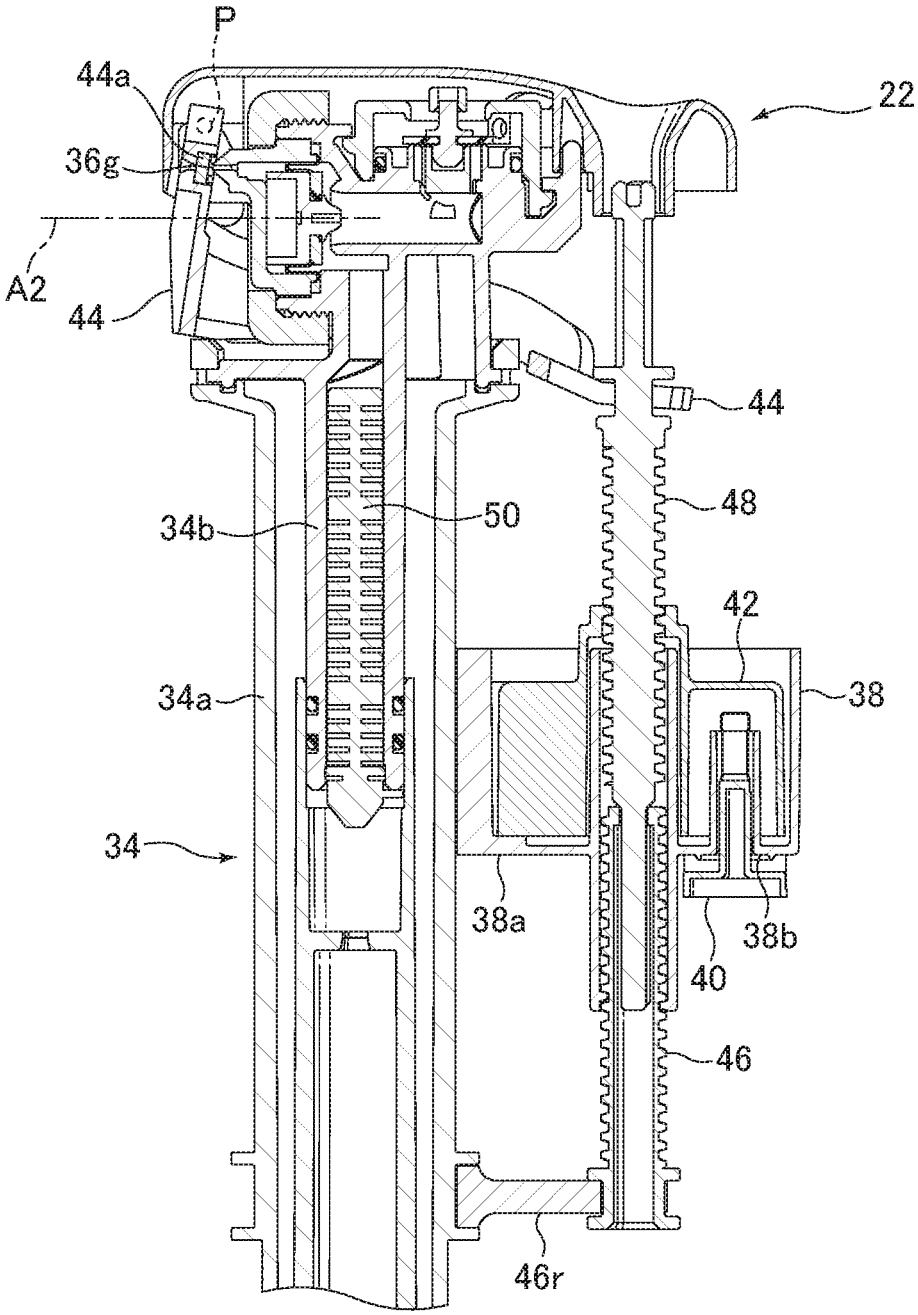
FIG. 5 is an enlarged section view of a main part of the flush water supply apparatus according to the first embodiment during a supply state (valve opened)
Figure 6:
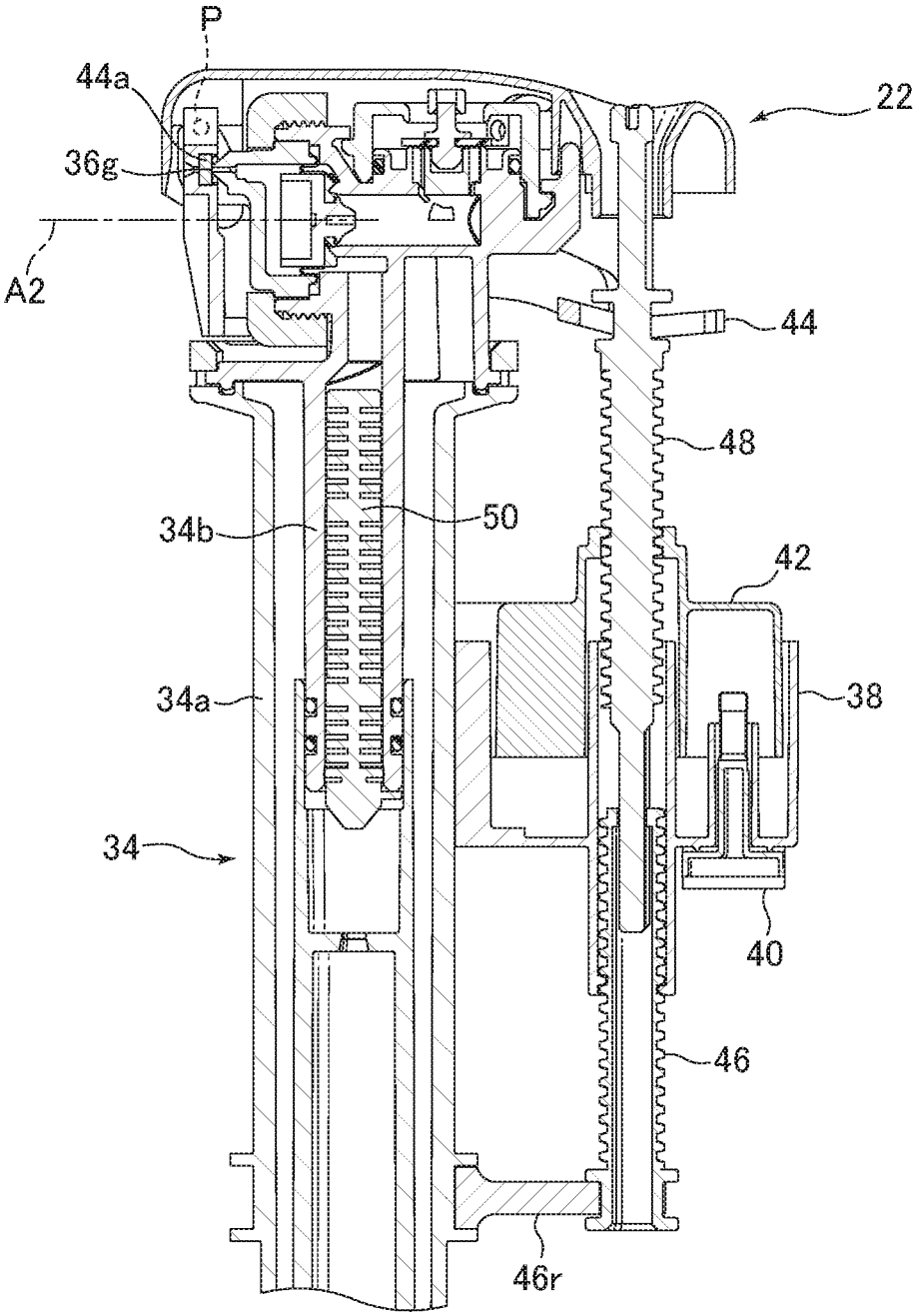
FIG. 6 is an enlarged section view of the main part of the flush water supply apparatus according to the first embodiment during a stop state (valve closes)

Next, FIG. 3 is an exploded perspective view of the flush water supply apparatus 22 according to the first embodiment, and FIG. 4 is a front longitudinal section view of the flush water supply apparatus 22 according to the first embodiment. In addition, FIG. 5 is an enlarged section view of a main part of the flush water supply apparatus 22 according to the first embodiment during a supply state (valve opened), and FIG. 6 is an enlarged section view of the main part of the flush water supply apparatus 22 according to the first embodiment during a stop state (valve closes). In FIG. 4, the flow of the flush water in primary and secondary passages is shown by arrows.

As shown in FIGS. 2 to 6, the flush water supply apparatus 22 according to the first embodiment is connected to an external water source (not shown), and has a water supply pipe 34 extending upward from a bottom surface 18*a* of the water storage tank 18, and a diaphragm type of water supply valve 36 for switching between a supply (dispensing) state and a stop state of the flush water supplied from the water supply pipe 34 into the water storage tank 18.

In addition, the flush water supply apparatus 22 has a small tank 38 movable in a vertical direction along the water supply pipe 34 and a float 42 provided in the small tank 38. The float 42 is slidable against the small tank 34 in a vertical direction in conjunction with a change of the water level of the flush water in the small tank 38. An opening 38*b* is formed through a bottom wall 38*a* of the small tank 38, on which a check valve is provided. Alternatively, an opening of the small tank 38 with a check valve may be formed at a side wall thereof.

Then, a swinging member 44 (e.g. swinging arm) is provided pivotably around a fulcrum on a valve housing 36*a* supported by the water supply pipe 34. When the swinging member 44 is pivoted (swung), a pilot hole 36*g* is opened or closed, which causes the water supply valve 36 to switch between the supply (dispensing) state and the stop state.

The pivoting (swinging) movement of the swinging member 44 is caused by a vertical movement of the float 42. That is to say, the swinging member 44 is connected to the float 42. Herein, the swinging member 44 and the float 42 are connected via a float-position adjusting member 48 so that the relative position between the swinging member 44 and the float 42 is adjustable.

Specifically, the float-position adjusting member 48 is in general a substantially tubular member. A male threaded part is provided on an outer side surface of the float-position adjusting member 48. On the other hand, a female threaded part is provided on a portion of an inner side surface of an attachment hole 42*a* formed at a center part of the float 42. Then, the male threaded part and the female threaded part are engaged to each other threadedly. Thus, when the float-position adjusting member 48 is circumferentially rotated around an axis thereof, the relative position between the float-position adjusting member 48 and the float 42 is adjusted so that the relative position between the swinging member 44 and the float 42 is adjustable.

Furthermore, a rotatable pipe member 46 extends vertically, through which the float-position adjusting member 48 extends axially. The rotatable shaft member 46 is supported by the water supply pipe 34 via a bracket 46*r* in such a manner that a rotation of the rotatable pipe member 46 around an axis thereof is allowed. A male threaded part is provided on an outer side surface of the rotatable pipe member 46. On the other hand, a female threaded part is provided on a portion of an inner side surface of an attachment hole 38*a* formed at a center part of the small tank 38. Then, the male threaded part and the female threaded part are engaged to each other threadedly. Thus, when the rotatable pipe member 46 is circumferentially rotated around an axis thereof, the relative position between the rotatable pipe member 46 and the small tank 38 is adjusted (the small tank 38 is vertically moved along the water supply pipe 34).

Herein, the first embodiment adopts a corotation structure wherein when the float-position adjusting member 48 is rotated, the rotational pipe member 46 is also rotated together with the float-position adjusting member 48 (corotation) and wherein when the rotational pipe member 46 is rotated, the float-position adjusting member 48 is also rotated together with the rotational pipe member 46 (corotation). However, in the corotation structure of the first embodiment, there is also intentionally provided such a "play" that a relative rotation (backrush) between the float-position adjusting member 48 and the rotational pipe member 46 is caused by at least 10 degrees or more when the rotational direction is switched.

In addition, as shown in FIGS. 2 to 4, the water supply pipe 34 is attached to the bottom surface 18*a* of the water storage tank 18. The water supply pipe 34 has a lower (outer) water supply pipe 34*a* connected to the external water source such as water supply facilities (not shown) and an upper (inner) water supply pipe 34*b* provided above the lower water supply pipe 34*a*. A primary passage 34*c* extends vertically on axial centers of the lower and upper water supply pipes 34*a*, 34*b*. A secondary passage 34*d* is formed inside the water supply pipe 34 but outside the primary passage 34*c*.

In addition, as shown in FIG. 4, a flowing-out port 34*e* is formed at a lower end of the secondary passage 34*d* of the lower water supply pipe 34*a*. Thereby, the flush water in the secondary passage 34*d* is supplied from the flowing-out port 34*e* into the water storage tank 18.

Furthermore, as shown in FIG. 4, a throttle hole 34*g* is formed in the primary passage 34*c* of the lower water supply pipe 34*b*. Thereby, an instantaneous flow amount of the flush water can be determined depending on a size of the throttle hole 34*g* (water-flow cross-sectional area of the throttle hole 34*g*).

In addition, as shown in FIGS. 3 and 4, a lower part of the upper water supply pipe 34*b* is inserted into an upper end part of the lower water supply pipe 34*a*. A filter member 50 is attached in the primary passage 34*c* in the lower part of the upper water supply pipe 34*b*, in order to remove dusts included in the flush water flowing from the lower water supply pipe 34*a* into the upper water supply pipe 34*b*.

Figure 7:
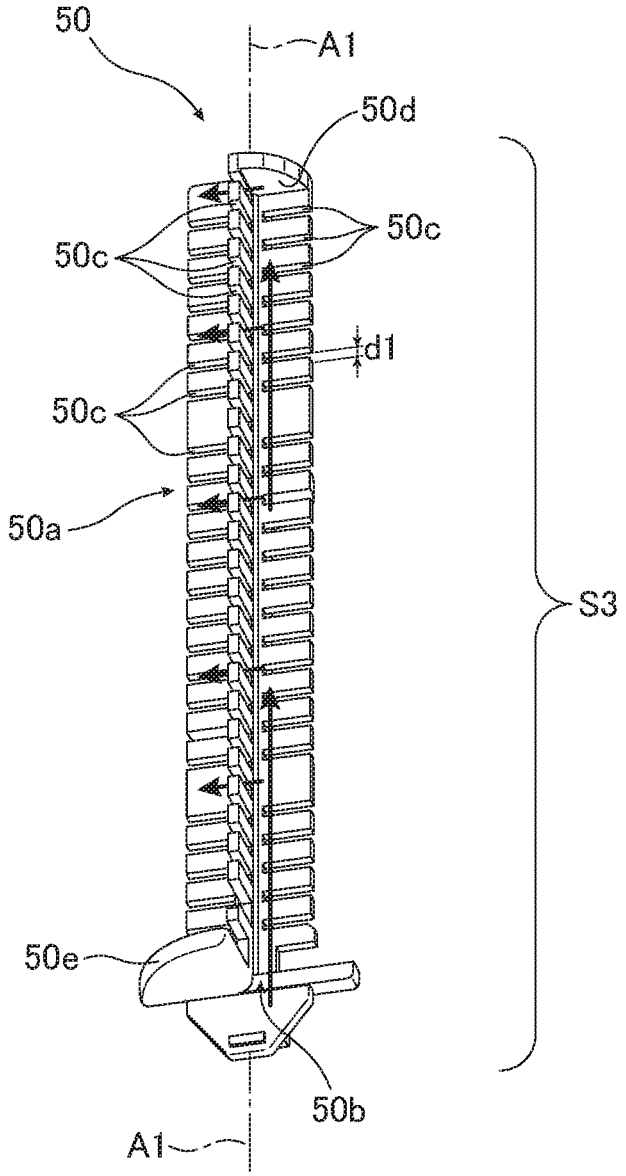
FIG. 7 is a perspective view from front and below of a filter member in the flush water supply apparatus according to the first embodiment.
Figure 8:
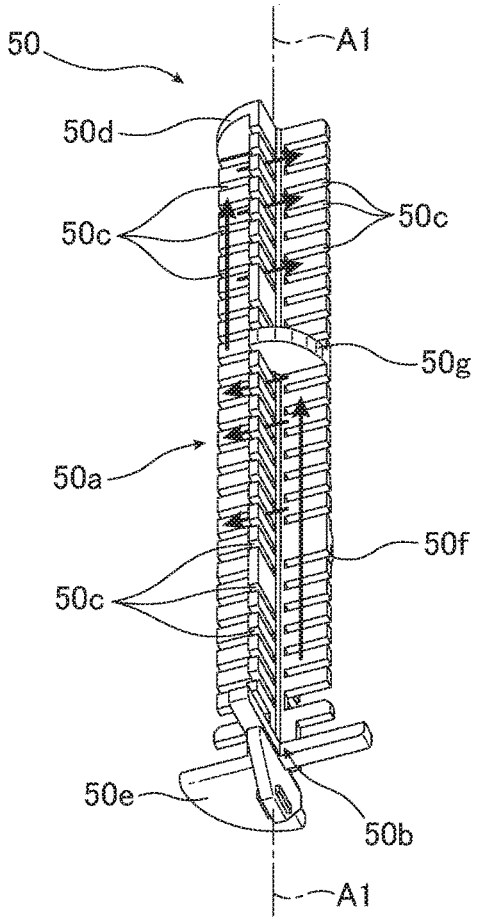
FIG. 8 is a perspective view from rear and below of the filter member in the flush water supply apparatus according to the first embodiment.
Figure 9:
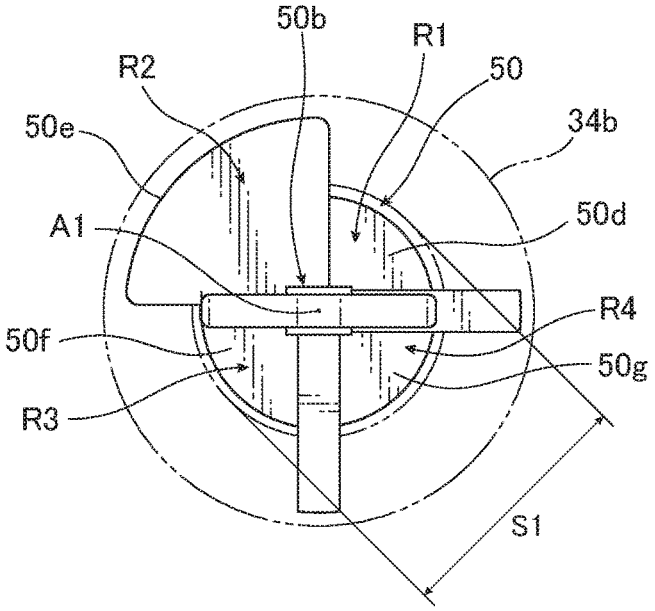
FIG. 9 is a bottom view of the filter member in the flush water supply apparatus according to the first embodiment.

FIG. 7 is a perspective view from front and below of the filter member 50 in the flush water supply apparatus 22 according to the first embodiment, FIG. 8 is a perspective view from rear and below of the filter member 50 in the flush water supply apparatus 22 according to the first embodiment, and FIG. 9 is a bottom view of the filter member 50 in the flush water supply apparatus 22 according to the first embodiment. In FIGS. 7 and 8, the flow of the flush water through the filter member 40 is shown by arrows.

As shown in FIGS. 3 to 9, the filter member 50 has a water-flow portion 50*a* that allows the flush water to flow but removes the dusts, and an attachment portion 50*b* provided at a lower end of the water-flow portion 50*a*. The attachment portion 50*b* is press-fitted into the primary passage 34*c* of the upper water supply pipe 34*b* so that the filter member 50 is fixed in the primary passage 34*c* of the upper water supply pipe 34*b*.

In addition, under the state wherein the attachment portion 50*b* of the filter member 50 is press-fitted and fixed in the primary passage 34*c* of the upper water supply pipe 34*b*, the water-flow portion 50*a* of the filter member 50 is not twistable around a longitudinal center axis A1 thereof. Thus, it is prevented that a water-flow cross-sectional area S1 of the filter member 50 (see FIG. 9) is made smaller than that of the throttle hole 34*g* (see FIG. 4) by the water-flow portion 50*a* being twisted.

Furthermore, as shown in FIGS. 7 and 8, in the water-flow portion 50*a* of the filter member 50, a plurality of slits 50*c*, each of which extends transversely, is aligned in a vertical direction. The width d1 of each slit 50*c* is substantially uniform (substantially the same size). The total area S3 of the water-flow cross-sectional areas of the plurality of slits 50*c* is set to be larger than that of the throttle hole 34*g* (see FIG. 4) of the lower water supply pipe 34*a*. Thereby, it is prevented that the dusts included in the flush water clog the filter member 50 when the flush water flows from the lower water supply pipe 34*a* to the upper water supply pipe 34*b* through the filter member 50, which inhibits a pressure loss of the flush water flowing through the filter member 50.

In addition, as shown in FIGS. 7 to 9, four regions R1 to R4 are substantially defined by the water-flow portion 50*a*. Specifically, the transversal section area of the filter member 50 is radially divided into the four regions R1 to R4. Each of transversely extending baffles 50*d* to 50*g* is provided in each of the four regions R1 to R4 and blocks the vertical flow of the flush water. In detail, the baffle 50*d* is provided at an upper end of the water-flow portion 50*a* in the region R1, the baffle 50*e* is provided at a lower end of the water-flow portion 50*a* in the region R2, the baffle 50*f* is provided at a middle portion of the water-flow portion 50*a* in the region R3, and the baffle 50*g* is provided at another middle portion of the water-flow portion 50*a* in the region R4.

In addition, as shown in FIGS. 3, 5 and 6, the water supply valve 36 is a diaphragm type of valve and is interposed between the primary passage 34*c* extending vertically in the upper water supply pipe 34*b* and the secondary passage 34*d* extending horizontally in the upper water supply pipe 34*b*. The water supply valve 36 includes: a valve housing 36*a* having a center axis A2 extending horizontally, a diaphragm 36*b* movable along the center axis A1 of the valve housing 36*a* in the left and right direction of FIGS. 5 and 6, and a valve body 36*c* attached to the diaphragm 36*b* and movable together with the diaphragm 36*b* in the left and right direction of FIGS. 5 and 6.

A bleed hole extending in parallel to the center axis A2 is formed in the diaphragm 36*b*. The bleed hole communicates the primary passage 34*c* of the upper water supply pipe 34*b* and a back pressure chamber adjacent to the diaphragm 36*b*. A pilot hole 36*g* is formed at a lateral portion of the back pressure chamber.

Furthermore, as shown in FIGS. 5 and 6, at a lateral portion of the valve housing 36*a* of the water supply valve 36, the swinging member 44 is attached pivotably around a fulcrum P located at an end of the valve housing 36*a*. The swinging member 44 has a valve body 44*a*, which opens and closes the pilot hole 36*g* of the water supply valve 36 by the pivoting (swinging) movement of the swinging member 44. When the valve body 44*a* of the swinging member 44 opens or closes the pilot hole 36*g* of the water supply valve 36, the water supply valve 36 can be switched between the supply (dispensing) state and the stop state.

In FIG. 5, the water level in the small tank 38 is substantially zero. The float 42 has fallen to the lowest position thereof, and the swinging member 44 has pivoted (swung) around the fulcrum P, so that the valve body 44*a* has opened the pilot hole 36*g* of the water supply valve 36. The valve body 36*c* has moved to the left side of FIG. 5 so that a valve seat located at an upstream end of the secondary passage 34*d* of the upper water supply pipe 34*b* has been opened (supply state).

On the other hand, in FIG. 6, the float 42 has been lifted up to the highest position thereof, and the swinging member 44 has pivoted (swung) around the fulcrum P, so that the valve body 44*a* has closed the pilot hole 36*g* of the water supply valve 36. The valve body 36*c* has moved to the right side of FIG. 5 so that the valve seat located at an upstream end of the secondary passage 34*d* has been closed (stop state).

Figure 10:
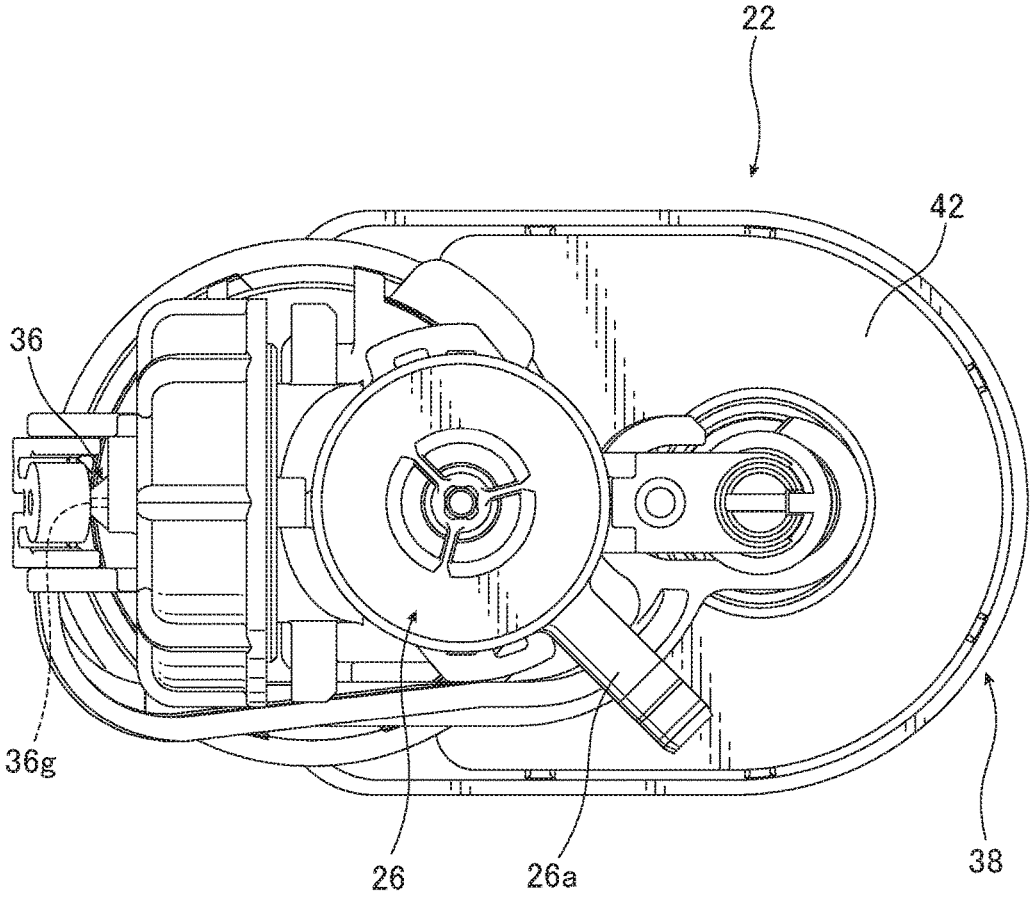
FIG. 10 is a plan view of the flush water supply apparatus according to the first embodiment, in which a cover member is removed.
Figure 11:
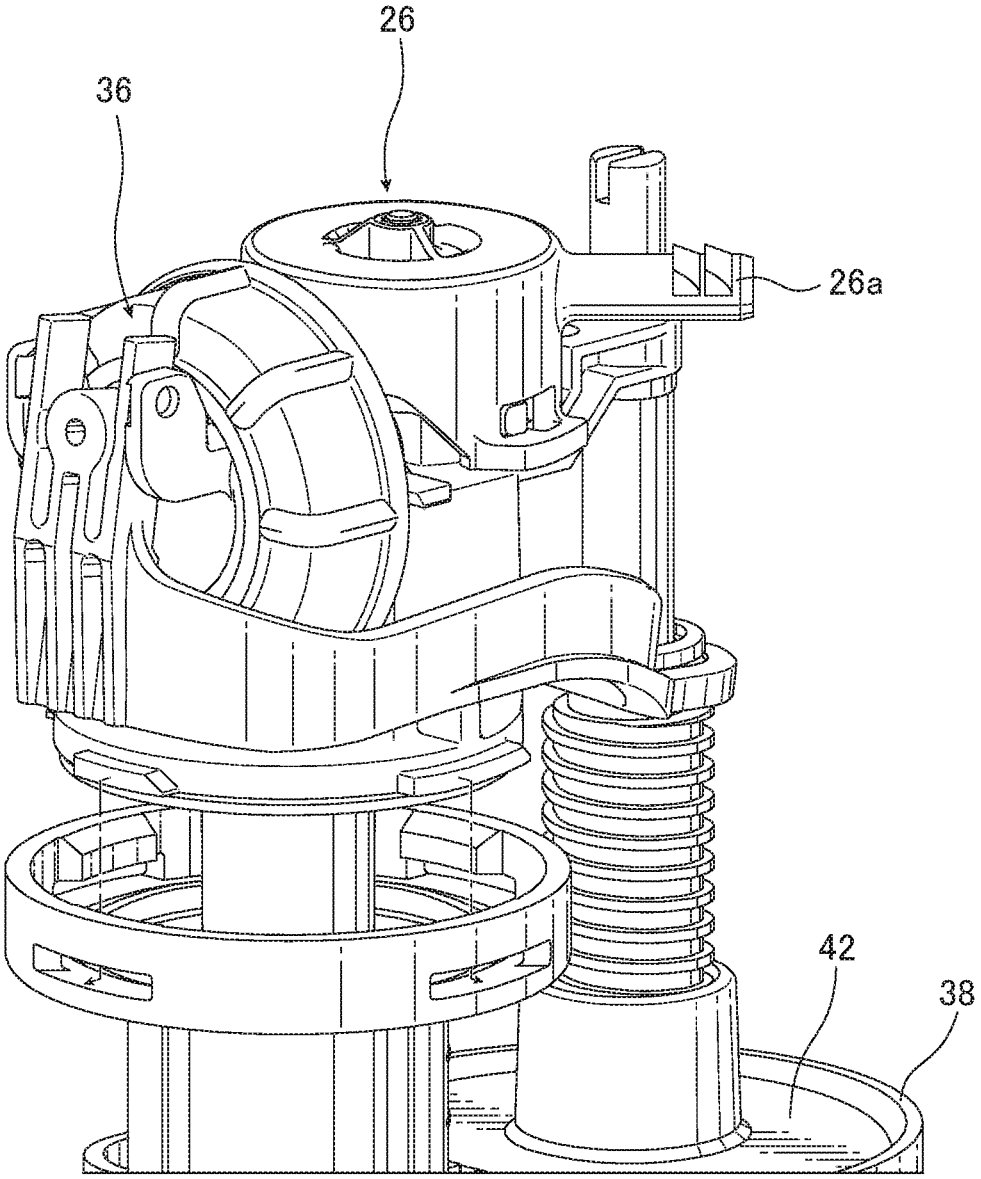
FIG. 11 is a partially exploded perspective view from rear of the flush water supply apparatus according to the first embodiment, in which the cover member is removed.

Furthermore, FIG. 10 is a plan view of the flush water supply apparatus according to the first embodiment, in which the cover member 52 is removed, and FIG. 11 is a partially exploded perspective view from rear of the flush water supply apparatus according to the first embodiment, in which the cover member 52 is removed.

As shown in FIGS. 3 to 6, 10 and 11, the small tank 38 and the float 42 are arranged on the same one side, opposite to the other side on which the pilot hole 36*g* of the water supply valve 36 is located, with respect to the lower water supply pipe 34*a*. Thereby, even if the flush water flows out from the pilot hole 36*g* when the float 42 falls and opens the pilot hole 36*g* of the water supply valve 36, the flush water having flown out from the pilot hole 36*g* drops down on the other side opposite to the small tank 38 and the float 42. Thus, it is prevented that the flush water having flown out from the pilot hole 36*g* might flow into the small tank 38.

(Basic Operation)

A basic operation of the flush water supply apparatus 22 of the first embodiment as described above is explained. The flush water supply apparatus 22 of the first embodiment can execute two flushing modes, i.e., a flushing mode for solid waste and a flushing mode for urine. Their basic operations are common, and thus only the flushing mode for solid waste is explained.

As shown in FIGS. 2, 4 and 6, the valve body (not shown) of the discharging valve apparatus 24 closes the discharging port 20 under a state wherein the discharging operation of the discharging valve apparatus 24 has not been started. For example, an initial water level in the water storage tank 18 is the full water level WLO (see FIG. 2), and thus the float 42 is submerged underwater.

Next, as shown in FIGS. 2, 4 and 6, when the operational lever 30 is rotated by a user, the discharging valve apparatus 24 opens the discharging port 20 of the water storage tank 18. Then, the flush water is discharged to the toilet main unit 2 for the flushing mode for solid waste, so that the water level in the water storage tank 18 starts to fall.

While the water level in the water storage tank 18 is maintained at or above a water pressure that can maintain the sealing function of the check valve 40, the water level in the small tank 38 is maintained. That is to say, the float 42 is maintained at the raised state. Thus, the flush water supply apparatus 22 does not supply the flush water.

Once the water level in the water storage tank 18 falls below the water pressure that can maintain the sealing function of the check valve 40, the check valve 40 also falls, and thus the opening 38*b* formed at the bottom wall 38*a* of the small tank 38 is opened. Thereby, the water level in the small tank 38 starts to fall.

Once the water level in the small tank 38 falls to the water level for starting to supply the flush water w1 (see FIG. 2), the floating power (buoyancy) exerted on the float 42 falls below the self-weight of the float 42. Thus, the float 24 starts to fall.

As a result, as shown in FIGS. 4 and 5, the swinging member 44 pivots (swings) around the fulcrum P, and thus the valve body 44*a* of the swinging member 44 opens the pilot hole 36*g* of the water supply valve 36. Thereby, the valve body 36*c* moves to the left side of FIG. 5, so that the valve seat located at the upstream end of the secondary passage 34*d* of the upper water supply pipe 34*b* is opened (supply state).

Furthermore, as shown in FIGS. 2, 4 and 5, when the water level in the water storage tank 18 falls to the dead water level DWL, the discharging valve apparatus 24 closes the discharging port 20 of the water storage tank 18 (the water level in the small tank 38 has become zero). At this time, the water supply valve 36 has been opened so that the flush water has continued to be supplied to the water storage tank 18. Thus, immediately, the water level in the water storage tank 18 is raised above the dead water level DWL.

When the water level in the water storage tank 18 is raised to the predetermined water level WL2, the check valve 30 is also raised to close the opening 38*b* of the bottom wall 38*a* of the small tank 38 (the water level in the small tank 38 has been still zero).

Once the water level in the water storage tank 18 is further raised and the flush water starts to flow into the small tank 38 over the upper edge thereof, the water level in the small tank 38 is rapidly raised. Thereby, the float 42 is rapidly raised, and thus the water supply valve 36 is rapidly closed (stop state).

According to the flush water supply apparatus 22 of the present embodiment, the small tank 38 and the float 42 are arranged on the same one side, opposite to the other side on which the pilot hole 36*g* of the water supply valve 36 is located, with respect to the lower water supply pipe 34*a*. Thereby, even if the flush water flows out from the pilot hole 36*g* when the float 42 falls and opens the pilot hole 36*g* of the water supply valve 36, the flush water having flown out from the pilot hole 36*g* drops down on the other side opposite to the small tank 38 and the float 42. Thus, it is prevented that the flush water having flown out from the pilot hole 36*g* might flow into the small tank 38.

In addition, in the present embodiment, the rotational pipe member 46 is located below the water-stop level WL1 in the water storage tank 18. Thus, a small-sized dust may float in the flush water and may stick to the rotational pipe member 46. However, in the present embodiment, in a corotation structure, a "play" is provided intentionally. Thus, no problem is raised because the "play" can remarkably reduce the possibility that a small-sized dust fills the gap between the float-position adjusting member 48 and the rotational pipe member 46 so that the float-position adjusting member 48 becomes vertically immovable to make it impossible for the flush water supply apparatus 22 to normally operate.

(Detail of Corotation Structure)

Figure 12:
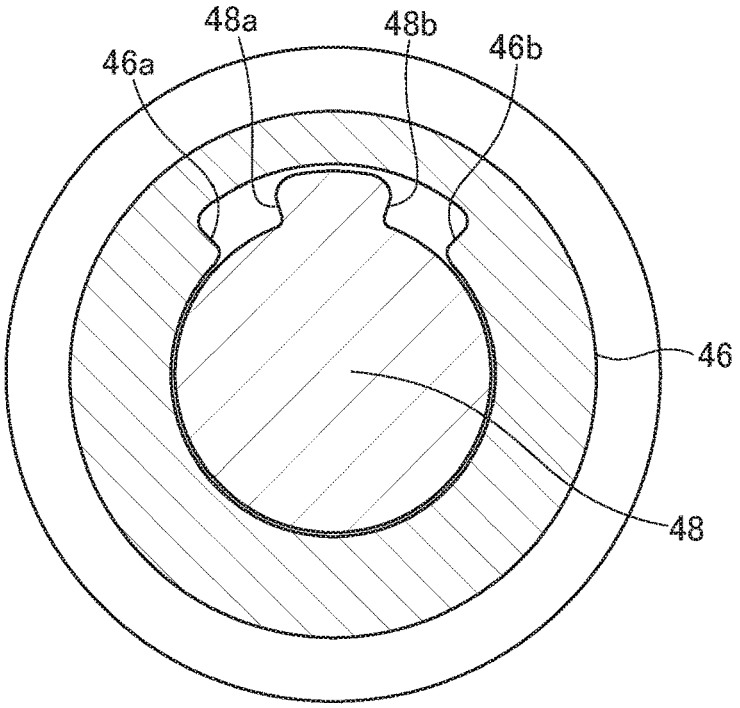
FIG. 12 is a transversal section view of the float-position adjusting member and the rotational pipe member (small-tank-position adjusting member) according to the first embodiment.

In the present embodiment, the float-position adjusting member 48 and the rotational pipe member 46 (small-tank-position adjusting member) are formed by inside and outside (double) coaxial members. Their cross sections are shown in FIG. 12 (which corresponds to (a part of) a cross section taken along plane (line) XII-XII of FIG. 4).

In the present embodiment, the float-position adjusting member 48 can be rotated in one direction by an user. During this rotation, as shown in FIG. 12, a first contact part 48*a* of the float-position adjusting member 48 comes in contact with a first contact part 46*a* of the rotational pipe member 46 (small-tank-position adjusting member) so that the float-position adjusting member 48 and the rotational pipe member 46 (small-tank-position adjusting member) are rotated in the one direction together with each other.

In addition, in the present embodiment, since a bracket member 46*r* is adopted, the rotational pipe member 46 (small-tank-position adjusting member) can be rotated in the other direction by the user as well. During this rotation, the first contact part 46*a* of the rotational pipe member 46 (small-tank-position adjusting member) comes in contact with the first contact part 48*a* of the float-position adjusting member 48 so that the rotational pipe member 46 (small-tank-position adjusting member) and the float-position adjusting member 48 are rotated in the other direction together with each other.

Reversely, in the present embodiment, the float-position adjusting member 48 can be rotated in the other direction by the user as well. During this rotation, a second contact part 48*b* of the float-position adjusting member 48 comes in contact with a second contact part 46*b* of the rotational pipe member 46 (small-tank-position adjusting member) so that the float-position adjusting member 48 and the rotational pipe member 46 (small-tank-position adjusting member) are rotated in the other direction together with each other.

In addition, in the present embodiment, since the bracket member 46*r* is adopted, the rotational pipe member 46 (small-tank-position adjusting member) can be rotated in the one direction by the user as well. During this rotation, the second contact part 46*a* of the rotational pipe member 46 (small-tank-position adjusting member) comes in contact with the second contact part 48*a* of the float-position adjusting member 48 so that the rotational pipe member 46 (small-tank-position adjusting member) and the float-position adjusting member 48 are rotated in the one direction together with each other.

As an essential feature of the present embodiment, from a state wherein the first contact part 48*a* of the float-position adjusting member 48 is in contact with the first contact part 46*a* of the rotational pipe member 46 to another state wherein the second contact part 48*b* of the float-position adjusting member 48 is in contact with the second contact part 46*b* of the small-tank-position adjusting member 46, the float-position adjusting member 48 and the rotational pipe member 46 are not rotated together with each other, but can rotate relative to each other by about 45 degrees. That is to say, such a "play" is provided intentionally (see FIG. 12).

Then, the "play" can function as a passage through which even a small-sized dust can pass. This can remarkably reduce the possibility that a small-sized dust fills the gap between the float-position adjusting member 48 and the rotational pipe member 46 so that the float-position adjusting member 48 becomes vertically immovable to make it impossible for the flush water supply apparatus 22 to normally operate.

In the embodiment shown in FIG. 12, the first contact part 48*a* and the second contact part 48*b* of the float-position adjusting member 48 are opposite parts of an outward projection (whose radius is 3.1 mm) which projects outwardly from an outside surface (whose radius is 2.4 mm) of an inside shaft member (or an inside pipe member). The circumferential width of the outward projection is about 30 degrees. The space between the first contact part 46*a* and the second contact part 46*b* of the rotational pipe member 46 is an inward recess (whose radius is 3.2 mm) which is concave from an inside surface (whose radius is 2.5 mm) of the outer pipe member 46. The circumferential width of the inward recess is about 75 degrees. As a result, a "play" having a length of 0.8 mm in a radial direction and a circumferential width of about 45 degrees is created.

It can be said that the first contact part 46*a* and the second contact part 46*b* of the rotational pipe member 46 are opposite parts of an inward projection which projects further inwardly from an inside surface of the rotational pipe member 46. The circumferential width of the inward projection is about 285 degrees.

According to the inventors, as long as the angle by which the float-position adjusting member 48 and the rotational pipe member 46 are rotatable relative to each other is 10 degrees or more, useful effects can be achieved to a certain extent. The angle range may correspond to the circumferential width of a "play".

However, if the angle by which the float-position adjusting member 48 and the rotational pipe member 46 are rotatable relative to each other is too large, the operation for adjusting the relative position is not easy. Thus, it is preferable that the angle by which the float-position adjusting member 48 and the rotational pipe member 46 are rotatable relative to each other is less than 120 degrees.

Figure 13:
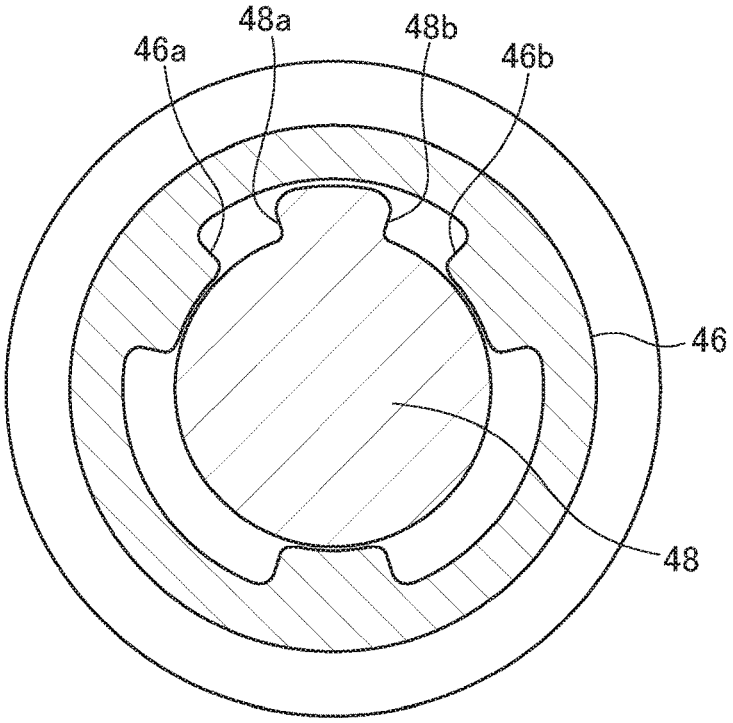
FIG. 13 is a transversal section view of a float-position adjusting member and a rotational pipe member (small-tank-position adjusting member) according to a second embodiment of the present invention.

Next, FIG. 13 is a transversal section view of a float-position adjusting member and a rotational pipe member (small-tank-position adjusting member) according to a second embodiment of the present invention.

As shown in FIG. 13, the rotational pipe member 46 of the present embodiment has three inward projections formed at regular intervals circumferentially, each of which projects further inwardly from the inside surface of the rotational pipe member 46. The first contact part 46*a* and the second contact part 46*b* of the rotational pipe member 46 are opposite parts of one inward projection among the three inward projections.

According to the second embodiment, additional passages (two concave portions among three concave portions between the three inward projections), through which even a small-sized dust can pass, are added in the areas not involved in the corotation. These additional passages can more remarkably reduce the possibility that a small-sized dust fills the gap between the float-position adjusting member 48 and the rotational pipe member 46 so that the float-position adjusting member 48 becomes vertically immovable to make it impossible for the flush water supply apparatus 22 to normally operate.

Figure 14:
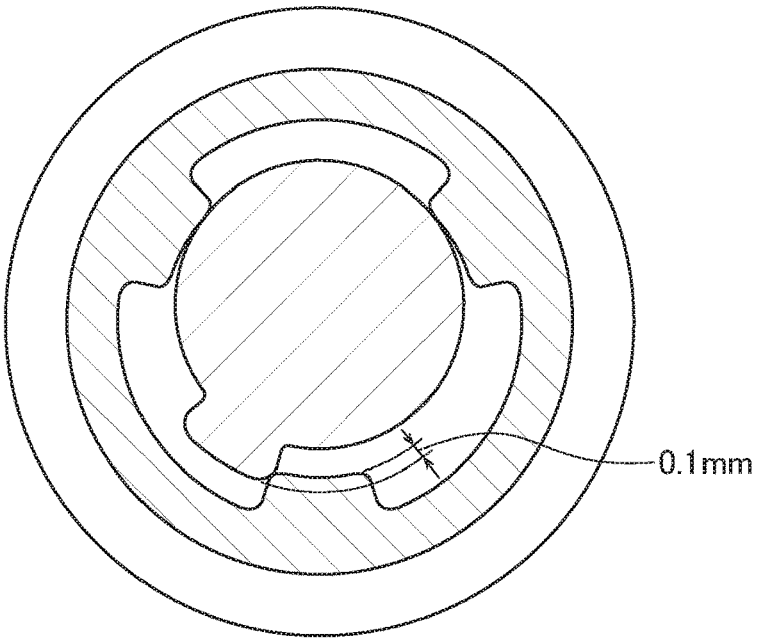
FIG. 14 is a transversal section view of a relative side-moving (deviation) state of the float-position adjusting member and the rotational pipe member (small-tank-position adjusting member) according to the second embodiment.

Herein, FIG. 14 is a transversal section view of a relative side-moving (deviation) state of the float-position adjusting member and the rotational pipe member (small-tank-position adjusting member) according to the second embodiment.

As shown in FIG. 14, in the second embodiment, when a so-called side-moving (deviation) happens, the corotation structure may not function well as desired.

Figure 15:
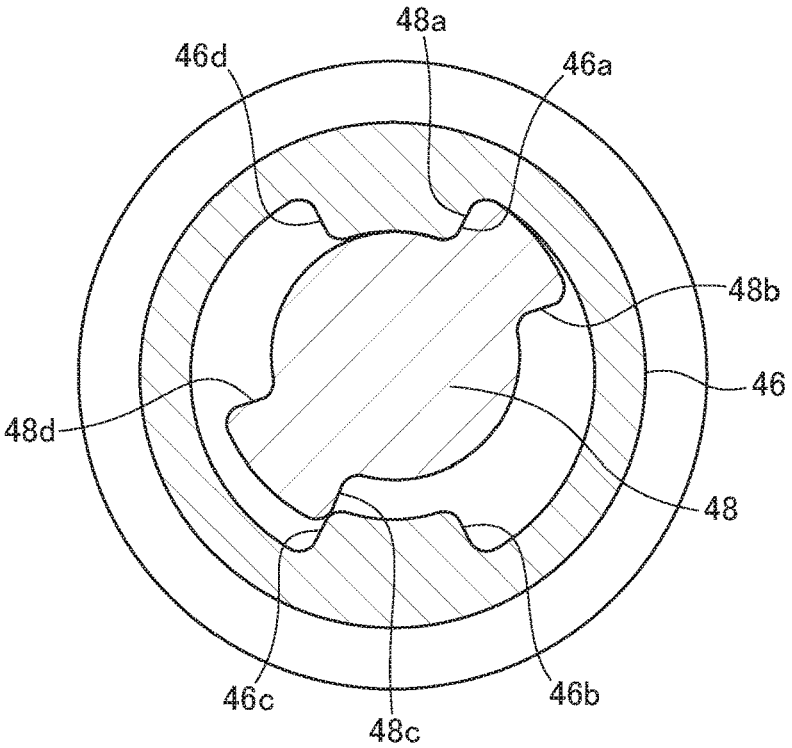
FIG. 15 is a transversal section view of a relative side-moving (deviation) state of a float-position adjusting member and a rotational pipe member (small-tank-position adjusting member) according to a third embodiment of the present invention.
Figure 16:
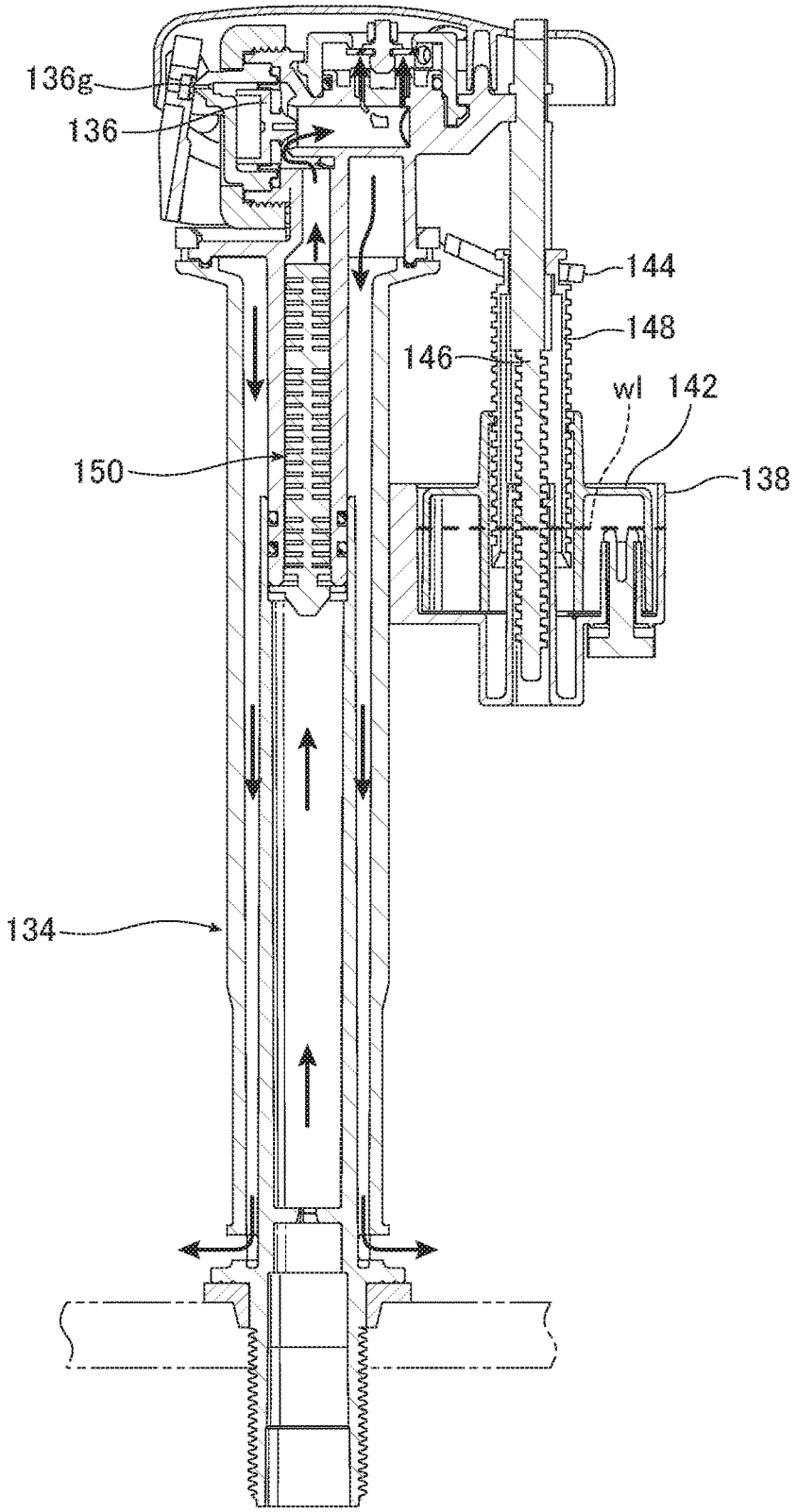
FIG. 16 is a front vertical section view of a conventional flush water supply apparatus.
Figure 17:
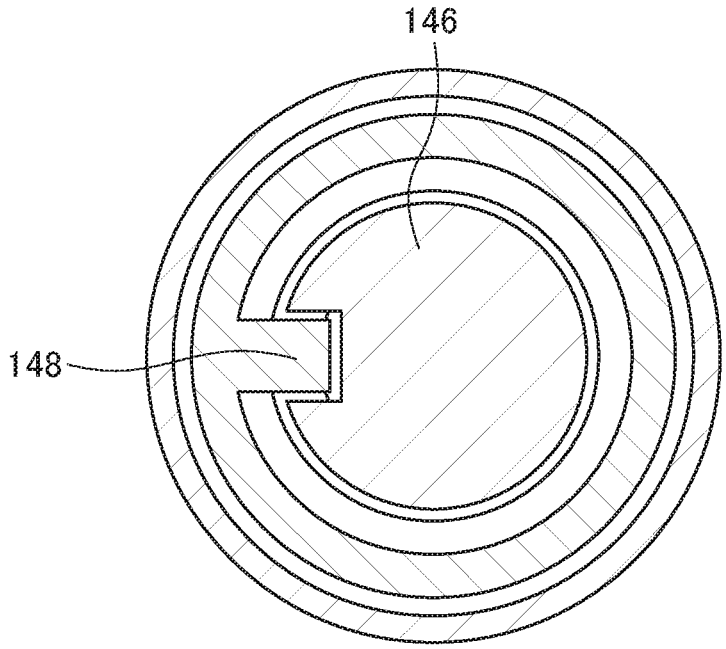
FIG. 17 is a transversal section view showing the conventional corotation.

FIG. 15 is a transversal section view of a relative side-moving (deviation) state of a float-position adjusting member and a rotational pipe member (small-tank-position adjusting member) according to a third embodiment of the present invention.

In the third embodiment, when the first contact part 48*a* of the float-position adjusting member 48 comes in contact with the first contact part 46*a* of the rotational pipe member 46, a third contact part 48*c* of the float-position adjusting member 48 comes in contact with a third contact part 46*c* of the rotational pipe member 46. In addition, when the second contact part 48*b* of the float-position adjusting member 48 comes in contact with the second contact part 46*b* of the rotational pipe member 46, a fourth contact part 48*d* of the float-position adjusting member 48 comes in contact with a fourth contact part 46*d* of the rotational pipe member 46.

In addition, the first contact part 48*a* and the third contact part 48*c* of the float-position adjusting member 48 are symmetrically located with respect to an axis of the float-position adjusting member 48, the second contact part 48*b* and the fourth contact part 48*d* of the float-position adjusting member 48 are symmetrically located with respect to the axis of the float-position adjusting member 48, the first contact part 46*a* and the third contact part 46*c* of the rotational pipe member 46 are symmetrically located with respect to an axis of the rotational pipe member 46, and the second contact part 46*b* and the fourth contact part 46*d* of the rotational pipe member 46 are symmetrically located with respect to the axis of the rotational pipe member 46.

According to the third embodiment, the float-position adjusting member 48 and the rotational pipe member 46 are rotated while the two (or more) sets of contact parts are in contact, which can stabilize the corotation movements.

In addition, according to the third embodiment, the float-position adjusting member 48 and the rotational pipe member 46 are rotated while the two (or more) sets of contact parts located at the well-balanced positions are in contact. This can stabilize the corotation movements even if a so-called side-moving (deviation) happens between the float-position adjusting member 48 and the rotational pipe member 46.

In the embodiment shown in FIG. 15, the first contact part 48*a* and the second contact part 48*b* of the float-position adjusting member 48 are opposite parts of an outward projection (whose radius is 3.1 mm) which projects outwardly from an outside surface (whose radius is 2.4 mm) of an inside shaft member (or an inside pipe member). The circumferential width of the outward projection is about 30 degrees. The third contact part 48*c* and the fourth contact part 48*d* of the float-position adjusting member 48 are opposite parts of another outward projection (whose radius is 3.1 mm) which projects outwardly from the outside surface (whose radius is 2.4 mm) of the inside shaft member (or the inside pipe member). The circumferential width of the second outward projection is also about 30 degrees.

The space between the first contact part 46*a* and the second contact part 46*b* of the rotational pipe member 46 is an inward recess (whose radius is 3.2 mm) which is concave from an inside surface (whose radius is 2.5 mm) of the outer pipe member 46. The circumferential width of the inward recess is about 120 degrees. The space between the third contact part 46*c* and the fourth contact part 46*d* of the rotational pipe member 46 is another inward recess (whose radius is 3.2 mm) which is concave from the inside surface (whose radius is 2.5 mm) of the outer pipe member 46. The circumferential width of the second inward recess is also about 120 degrees.

According to the above dimensions, two "plays" are created, each of which has a length of 0.8 mm in a radial direction and a circumferential width of about 90 degrees.

In each of the above embodiments, the float-position adjusting member 48 is located inside and the rotational pipe member 48 is located outside. However, an opposite layout regarding the inside and outside arrangement may be adopted.

What is claimed is:

1. A flush water supply apparatus for supplying flush water into a flush water tank of a toilet, the flush water supply apparatus comprising:

a water supply valve for switching between a supply state and a stop state of flush water supplied from a water supply pipe into a flush water tank;

a small tank provided in the flush water tank;

a float provided in the small tank, the float being slidable against the small tank in a vertical direction in conjunction with a change of a flush water level in the small tank;

an arm for causing the water supply valve to switch between the supply state and the stop state, in conjunction with a vertical movement of the float against the small tank;

a float-position adjusting member connected to the arm and the float, the float-position adjusting member being circumferentially rotatable around an axis thereof so that a relative position between the arm and the float is adjustable; and a small-tank-position adjusting member connected to the small tank, the small-tank-position adjusting member being circumferentially rotatable around an axis thereof so that a vertical position to which the small tank is supported is adjustable;

wherein the float-position adjusting member and the small-tank-position adjusting member are coaxially arranged, when the float-position adjusting member is rotated in one direction, a first contact part of the float-position adjusting member comes in contact with a first contact part of the small-tank-position adjusting member so that the float-position adjusting member and the small-tank-position adjusting member are rotated in the one direction together with each other, and/or when the small-tank-position adjusting member is rotated in the other direction, the first contact part of the small-tank-position adjusting member comes in contact with the first contact part of the float-position adjusting member so that the float-position adjusting member and the small-tank-position adjusting member are rotated in the other direction together with each other, when the float-position adjusting member is rotated in the other direction, a second contact part of the float-position adjusting member comes in contact with a second contact part of the small-tank-position adjusting member so that the float-position adjusting member and the small-tank-position adjusting member are rotated in the other direction together with each other, and/or when the small-tank-position adjusting member is rotated in the one direction, the second contact part of the small-tank-position adjusting member comes in contact with the second contact part of the float-position adjusting member so that the float-position adjusting member and the small-tank-position adjusting member are rotated in the one direction together with each other, the float-position adjusting member and the small-tank-position adjusting member are rotatable to each other from a state wherein the first contact part of the float-position adjusting member is in contact with the first contact part of the small-tank-position adjusting member to another state wherein the second contact part of the float-position adjusting member is in contact with the second contact part of the small-tank-position adjusting member, and an angle by which the float-position adjusting member and the small-tank-position adjusting member are rotatable to each other is 10 degrees or more.

2. The flush water supply apparatus according to claim 1, wherein the angle by which the float-position adjusting member and the small-tank-position adjusting member are rotatable to each other is less than 120 degrees.

3. The flush water supply apparatus according to claim 1, wherein the arm is supported by the flush water tank or the water supply pipe in a movable manner, the arm is configured to cause the water supply valve to switch between the supply state and the stop state in accordance with a movement of the arm;

the float-position adjusting member is supported by the flush water tank or the water supply pipe via the arm, and the small tank is supported by the flush water tank or the water supply pipe via the small-tank-position adjusting member.

4. The flush water supply apparatus according to claim 1, wherein a part of the water supply pipe extends into the flush water tank, the small tank is supported by the water supply pipe via the small-tank-position adjusting member and a bracket member, and the small-tank-position adjusting member is supported by the bracket member in such a manner that the small-tank-position adjusting member is circumferentially rotatable around an axis of the small-tank-position adjusting member against the bracket member.

5. The flush water supply apparatus according to claim 1, wherein one set of the first and second contact parts of the float-position adjusting member and the first and second contact parts of the small-tank-position adjusting member are parts of one or more outward projections which project outwardly from an outside surface of a solid shaft member or a hollow tubular member, and the other set of the first and second contact parts of the float-position adjusting member and the first and second contact parts of the small-tank-position adjusting member are parts of one or more inward projections which project inwardly from an inside surface of another hollow tubular member.

6. The flush water supply apparatus according to claim 5, wherein each of the one or more outward projections and/or the one or more inward projections is one of a plurality of projections formed at regular intervals circumferentially.

7. The flush water supply apparatus according to claim 1, wherein when the first contact part of the float-position adjusting member comes in contact with the first contact part of the small-tank-position adjusting member, a third contact part of the float-position adjusting member comes in contact with a third contact part of the small-tank-position adjusting member, and when the second contact part of the float-position adjusting member comes in contact with the second contact part of the small-tank-position adjusting member, a fourth contact part of the float-position adjusting member comes in contact with a fourth contact part of the small-tank-position adjusting member.

8. The flush water supply apparatus according to claim 7, wherein the first contact part and the third contact part of the float-position adjusting member are substantially symmetrically located with respect to an axis of the float-position adjusting member, the second contact part and the fourth contact part of the float-position adjusting member are substantially symmetrically located with respect to the axis of the float-position adjusting member, the first contact part and the third contact part of the small-tank-position adjusting member are substantially symmetrically located with respect to an axis of the small-tank-position adjusting member, and the second contact part and the fourth contact part of the small-tank-position adjusting member are substantially symmetrically located with respect to the axis of the small-tank-position adjusting member.

9. The flush water supply apparatus according to claim 1, wherein the small-tank-position adjusting member is located below a water-stop level in the flush water tank.

* * * * *